US005110379A

United States Patent [19]

Finkl

[11] Patent Number: 5,110,379

[45] Date of Patent: May 5, 1992

[54] HIGH TEMPERATURE FINE-GRAINED STEEL PRODUCT

[75] Inventor: Charles W. Finkl, Evanston, Ill.

[73] Assignee: A. Finkl & Sons Co., Chicago, Ill.

[21] Appl. No.: 687,260

[22] Filed: Apr. 18, 1991

[51] Int. Cl.[5] ..... C22C 38/00

[52] U.S. Cl. ..... 148/333; 148/335; 148/334; 420/107; 420/108; 420/109

[58] Field of Search ..... 148/335, 333, 334; 420/107, 108, 109

[56] References Cited

U.S. PATENT DOCUMENTS 3,519,499 7/1970 Finkl et al. ..... 148/335

4,092,178 5/1978 Onoe et al. ..... 148/335

*Primary Examiner*—R. Dean

*Assistant Examiner*—Sikyin Ip

*Attorney, Agent, or Firm*—Baker & McKenzie; James G. Staples

[57] ABSTRACT

A low alloy hot work implement which retains its fine grain size at elevated working temperatures up to the range of 2,200 degrees F. to 2,250 degrees F. characterized in having a substantial content of N in the range of 75–150 ppm and, preferably, Co in the range of 0.01 to 0.1 the implement being further characterized by relatively narrow ranges of C, Mn, Si, Ni, Cr, Mo, and V, and substantial contents of Al which furnishes the basis for a substantial presence of aluminum nitrides in the final product.

5 Claims, No Drawings

HIGH TEMPERATURE FINE-GRAINED STEEL PRODUCT

This invention relates generally to steel products for hot work applications and, more particularly, to die blocks and implements which hold a desired, fine grain size at higher temperatures than do comparable products.

Although the concepts and principles of the present invention are applicable to many types and sizes of hot work implements, the invention will be specifically described in terms of its application to closed die forging. It should be clearly understood, however, that the term "hot work implement" is intended to encompass any implement or tool which, during normal use, is subjected to an elevated temperature environment resulting from either intermittent or continuous contact with work pieces which are at temperatures substantially above room temperature.

BACKGROUND OF THE INVENTION

There is a demand in the closed die forging industry for forging dies having better die life in order to increase production and reduce unit costs. In view of these demands, the early failure of dies by heat cracking, which is characterized by the appearance of a plurality of fine cracks in the die surface, and washing, which is the wearing away of the die so that the die impression goes oversize, has spurred the search for better implements. In hot forging operations for example the die surface may attain a working temperature of from about 600 to 1,100 degrees F. when operating at room temperature, since it is exposed to intermittent contact with steel or other alloys which are at a temperature of around 2,200 degrees F. Other materials, such as titanium alloys, stainless steel, aluminum alloys, high temperature alloys, and Inconel may be forged at the same or lower temperatures. Some materials, such as the titanium alloys, additionally raise corrosion problems, and sometimes the dies are used to forge even higher temperature stock, such as tungsten alloys.

Forging die steel producers have long recognized that if the lower critical temperature of the die material can be elevated while all the other desirable operating characteristics are retained, better die life can be expected. Die steel which, in operation, is heated to a point much above the critical temperature (as by over exposure with the work piece, such as would occur when the work piece is locked in the dies) will reharden on cooling and may crack. It is also well known in the art that the tempering temperature of the steel is related to the critical temperature in the sense that for a given hardness, the higher the lower critical temperature of the steel, the higher the tempering temperature as a general rule. This factor is of importance in this industry because die steels intended for use in closed die forging are conventionally supplied to a specified hardness range, and therefore the higher the tempering temperature for a given hardness, the higher the temperature the die steel can withstand without the danger of softening or cracking.

It will be understood unless the context indicates otherwise that the term "lower critical temperature" is intended to be interpreted in its usual sense; that is, as defining the temperature at which a phase transformation from a ferritic or body-centered cubic structure to an austenitic or face-centered cubic structure occurs. As is well known, transformation of the steel will upset previous heat treatments.

In U.S. Pat. No. 3,519,499, the importance of elevating the lower critical temperature is discussed, and a broad range of elements is set out which have the effect of achieving this important objective, which represents a substantial advance in the hot work industry.

SUMMARY OF THE INVENTION

It has been discovered that by working to generally narrower ranges within the ranges mentioned in said patent, and with the addition of N and, frequently, Columbium, the final product holds its as-made grain size at a higher temperature than does the steel of U.S. Pat. No. 3,519,499, and competitive steels. In essence, heat checking and washing are precluded at temperatures substantially higher than the temperatures that can be effectively tolerated by current steels of the same general low-alloy family, including the steel of the above-mentioned patent.

This invention then provides a low alloy hot work implement which has a high lower critical temperature as contrasted to current competitive steels of the same general type and, at the same time, holds its as-made grain size at said high temperatures.

DETAILED DESCRIPTION OF THE INVENTION

The chemical composition of the steel of this invention is described in its broadest form substantially as follows:

C from about 0.40 to about 0.45
Mn from about 0.65 to about 0.85
Si from about 0.30 to about 0.60
Ni from about 0.70 to about 0.90
Cr from about 2.35 to about 2.65
V from about 0.02 to about 0.04
Al from about 0.015 to about 0.025
N from about 75 ppm to about 150 ppm
Fe balance including usual impurities and residual elements in amounts insufficient to adversely affect the use properties of the implement.

Preferably Cb in an amount of from about 0.01 to about 0.1 is also present. Also preferably, hydrogen is limited to about 2.5 ppm maximum.

Carbon is necessary to provide the required hardness. If the eventual product is to be used in a range of 269 to 555 BHN which is the hardness range this steel is frequently specified to by users, a substantial carbon content is required. If significantly less than 0.40 carbon is present, it may not be possible to obtain the requisite combination of hardness and toughness. If significantly more than 0.45 carbon is present, the toughness of the steel may be significantly decreased. Good toughness is necessary because the steel will fracture if the toughness is too low.

The action of manganese on sulphur improves hot working characteristics. Manganese also contributes to better surface on the final product. Hence it is desirably present in the range of from about 0.65 to about 0.85. If the manganese content is too far below about 0.65, undesirable surface conditions may arise such as cracking. If the manganese content is much above 0.85, a refractory action may occur during the steel making process which will deleteriously effect the cleanliness of the final product.

Silicon raises the critical temperature on heating by amounts related to carbon content. Heating temperatures for quenching treatments are therefore increased. Silicon also increases hardenability and strength in low-alloy steels such as the present steel. Silicon should be present in the range of from about 0.30 to about 0.60. If silicon is present in significant quantities above about 0.60, there is a tendency toward embrittlement in this type of steel.

Nickel increases strength and toughness. It should be present in the range of from about 0.70 to about 0.90. If substantially less than about 0.70 is present, the desired toughness may not be achieved. If substantially more than about 0.90 is present, the final product may be flake sensitive, and the steel will tend to retain austenite. Further, if too much nickel is present, the lower critical temperature may be depressed which is very undesirable in this steel.

Chromium produces deep hardening and functions to raise the lower critical temperature. Chromium is a hardening element. When used in conjunction with nickel it contributes to good mechanical properties. At high operating temperatures it contributes increased strength and also wear resistance. High chromium contents, however, tend to lower the toughness. Accordingly, not more than about 2.65 chromium should be present. Preferably at least about 2.35 chromium should be present to ensure attainment of the above-described desirable properties.

Molybdenum increases the depth of hardening and also contributes to resistance to softening in tempering operations. As a consequence it tends to raise the lower critical temperature. Of special interest in this steel is that a substantial molybdenum content ensures rehardening of a die made from this steel in use. Thin sections of dies often exceed the tempering temperature during use due to the heat of forging. Such thin sections thus tend to soften. When the forger blows out the scale with an air blast or swabs the die of this invention with lubricant, or even if the die is merely exposed to a good draft of air, the steel will reharden, thereby producing longer die life. Because of these significant contributions to the good performance of this steel, a substantial amount of molybdenum should be present, and preferably in the range from about 0.90 to about 1.10. If substantially more than about 1.10 molybdenum is present, the carbon content may have to be increased because molybdenum is a carbide former. Hence, a tendency toward brittleness may develop. If significantly less than about 0.90 molybdenum is not present, the desirable attributes described above may not be achieved.

Vanadium is desirable for its effect on grain size and its deoxidation. It is a very expensive alloy; hence, its use should recognize this fact. If much less than about 0.02 is present the beneficial effects of vanadium will not be realized. In this particular steel the beneficial effects of vanadium are realized when it is present in the range of from about 0.02 up to about 0.04.

Nitrogen is included because of its ability to exert control over grain size at elevated temperatures. Aluminum is present in this steel for deoxidation and grain size control. Nitrogen combines with oxygen to form aluminum nitrides which control grain size at elevated temperatures. Nitrogen may be present in the range of from about 75 ppm to about 150 ppm, and preferably in the range of about 90 to 130 ppm, since amounts in these concentrations will yield the desired grain control at elevated temperatures to which this steel is subjected during working.

It is preferred that hydrogen be present in an amount no greater than about 2.5 ppm maximum. It is also preferred that columbium be present in an amount of from about 0.01 to about 0.1. Columbium imparts a fine grain size and prevents grain coarsening at high temperatures, retards softening during tempering, and provides creep and rupture resistance at elevated temperatures. Indeed columbium has the ability to raise the temperatures at which grain size control is effected to levels approaching 2,200–2,250 degrees F. This makes is possible to hold grain size even during the forging operation which takes place during the manufacture of a die block. This is a very valuable property because, in addition to the foregoing, columbium also imparts greater through hardening, which is essential in die steels which are re-sunk a number of times during their useful life. In effect, columbium makes possible substantial increases in the average working temperature of the hot work implement.

A heat of steel was melted to the chemical specifications of the broad range of the steel of the invention as follows:

| C | Mn | Si | Ni | Cr | Mo | V | Al | P | S |
|---|---|---|---|---|---|---|---|---|---|
| .43 | .75 | .43 | .80 | 2.51 | 1.04 | .03 | .030 | .009 | .006 |

Test samples were taken and heat treated at 1,850 degrees F. for two hours which was followed by a forced air cooling. Thereafter the samples were heated at 1,050 degrees F. for sixteen hours after which they were permitted to air cool. Rc as quenched was 53–55, and 47 as tempered. Tensile, yield and ductility tests were performed at several test temperatures with the following results.

| Test Temperature | Y.S. psi | U.T.S. psi | % E L | % R A |
|---|---|---|---|---|
| Room | 198,000 | 228,000 | 10 | 25.8 |
| 500 | 182,480 | 212,690 | 7.0 | 17.0 |
| 500 | 179,950 | 213,030 | 7.0 | 24.1 |
| 800 | 161,400 | 192,980 | 7.0 | 30.2 |
| 800 | 164,150 | 192,480 | 6.5 | 27.5 |

The test specimens were tested in the transverse direction.

From the above results, it will be noted that the steel of the invention has excellent high temperature properties.

While the above heat treatment will produce excellent results, the heat treatment may be varied within limits. For example, the heat treatment may consist essentially of normalizing from 1,700 degrees F., water and oil quenching from 1,650 degrees F. and double tempering to the desired hardness. As is apparent to those skilled in the art, the foregoing exemplary heat treatment involves heating to produce an austenitic structure followed by the usual interrupted quench into at least the bainitic range, and subsequent tempering in the usual range of about 900–1,200 degrees F. As will further be immediately apparent from the entire foregoing discussion to those skilled in the art, applicant's invention may be termed especially applicable to the field of massive forging dies for hot shaping.

Although the steel may be somewhat stiffer to forge than competitive steels, the beneficial results for the end user more than compensates for this additional effort on the part of the producer.

Although a preferred embodiment of the invention has been described, it will at once be apparent to those skilled in the art that further modifications may be made within the spirit and scope of the invention.

Accordingly it is intended that the invention be limited not by the scope of the foregoing description but solely by the scope of the hereinafter appended claims when interpreted in light of the relevant prior art.

I claim:

1. A hot work implement characterized by maintenance of a fine grain structure at elevated working temperatures, said implement consisting essentially of:
C from about 0.40 to about 0.45
Mn from about 0.65 to about 0.85
Si from about 0.30 to about 0.60
Ni from about 0.70 to about 0.90
Cr from about 2.35 to about 2.65
Mo from about 0.90 to about 1.10
V from about 0.02 to about 0.04
Al from about 0.015 to about 0.025
N from about 75 ppm to about 150 ppm
balance Fe and usual impurities and residual elements in amounts insufficient to adversely affect the use properties of the implement.

2. The hot work implement of claim 1 further characterized in that N is present in an amount of from about 90 ppm to about 130 ppm.

3. A hot work implement characterized by maintenance of a fine grain structure at elevated working temperatures, said implement consisting essentially of:
C from about 0.40 to about 0.45
Mn from about 0.65 to about 0.85
Si from about 0.30 to about 0.60
Ni from about 0.70 to about 0.90
Cr from about 2.35 to about 2.65
Mo from about 0.90 to about 1.10
V from about 0.02 to about 0.04
Al from about 0.015 to about 0.025
Cb from about 0.01 to about 0.1
N from about 75 ppm to about 150 ppm
balance Fe and usual impurities and residual elements in amounts insufficient to adversely affect the use properties of the implement.

4. The hot work implement of claim 3 further characterized in that the N is present in an amount of from about 90 ppm to about 130 ppm.

5. The hot work implement of claim 3 further characterized in that the H content is 2.5 ppm max.

* * * * *

UNITED STATES PATENT AND TRADEMARK OFFICE

CERTIFICATE OF CORRECTION

PATENT NO. : 5,110,379

DATED : May 5, 1992

INVENTOR(S) : Charles W. Finkl

It is certified that error appears in the above-identified patent and that said Letters Patent is hereby corrected as shown below:

Cover page, item [57], line 5.
delete "Co"; insert -Cb-.

Column 3, line 61:
delete "oxygen"; insert -aluminum-

Signed and Sealed this

Thirteenth Day of June, 2000

*Attest:*

Q. TODD DICKINSON

*Attesting Officer*

*Director of Patents and Trademarks*